United States Patent [19]

Salvino

[11] 4,094,473

[45] June 13, 1978

[54] PORTABLE DEVICE FOR SUPPORTING A ROLL OF ALUMINUM SHEETING FOR DISPENSING

[76] Inventor: Lawrence P. Salvino, 285 Milton Rd., Wauconda, Ill. 60084

[21] Appl. No.: 795,293

[22] Filed: May 9, 1977

[51] Int. Cl.[2] ..... B65H 75/02

[52] U.S. Cl. ..... 242/55; 242/68.7

[58] Field of Search ..... 242/55, 55.2, 68.7, 242/78.7, 129; 206/386

[56] References Cited

U.S. PATENT DOCUMENTS

| | | | |
|---|---|---|---|
| 1,854,033 | 4/1932 | Hudson | 242/68.7 X |
| 2,757,880 | 8/1956 | De La Motte | 242/78.7 |
| 2,833,489 | 5/1958 | Hall | 242/78.7 |
| 3,652,028 | 3/1972 | Ukai et al. | 242/129 |

*Primary Examiner*—Leonard D. Christian
*Attorney, Agent, or Firm*—Rummler & Snow

[57] ABSTRACT

A portable device for supporting a roll of aluminum sheeting having a stationary lower arcuate-shaped member supported on a stand and an upper arcuate-shaped member having one end pivotally secured to one end of the lower member, adjustable means for retaining the upper member on the roll of aluminum to retain it between the arcuate members and adjustable roller means on opposite sides of said roll of aluminum to retain it within the members.

4 Claims, 5 Drawing Figures

PORTABLE DEVICE FOR SUPPORTING A ROLL OF ALUMINUM SHEETING FOR DISPENSING

BACKGROUND OF THE INVENTION

Heretofore, when making one piece drain gutters on the jobsite, the roll of aluminum is placed on the ground and the same, being rolled, usually unrolls itself full length as the sheet is fed through the dies, thus the roll picks up dirt, grass stains and the like and soils the aluminum sheet.

The field of invention is a cradle for supporting a roll of aluminum sheeting for use in making on-site gutters whereby the aluminum will be kept clean.

SUMMARY OF THE INVENTION

A portable device for holding a roll of aluminum sheeting used for making one piece gutters on a jobsite on a horizontal axis, which allows the roll to rotate therein as the sheet is withdrawn therefrom, including an adjustable plate to maintain several sizes of rolls in the unit, as well as adjustable side guide rollers to retain the roll within the unit.

DETAILED DESCRIPTION OF THE DRAWINGS

Figure 1:
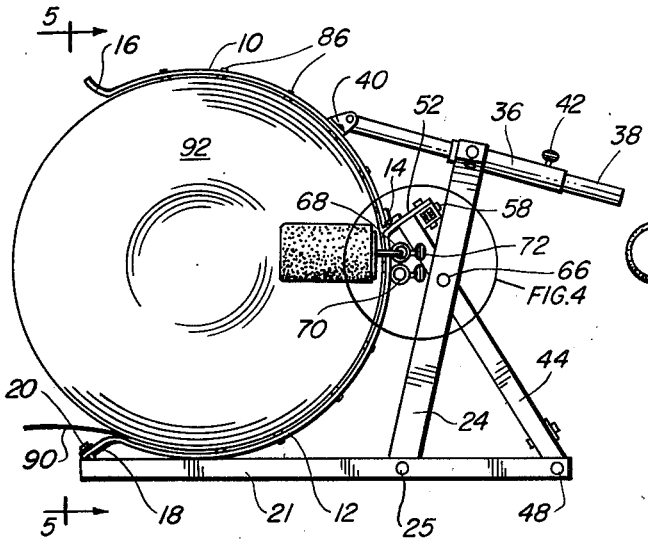
FIG. 1 is a side elevational view of the device of the present invention.

The present device comprises a pair of relatively wide, heavy gage aluminum upper and lower plates 10, 12 each bent on a radius and hingedly connected together by a piano hinge 14, with the free edge 16 of the plate 10 being turned outwardly, and upwardly. The free edge 18 of the plate 12 is bent downwardly and anchored by the bolts 20 to the lower base frames 21, 22.

Figure 2:
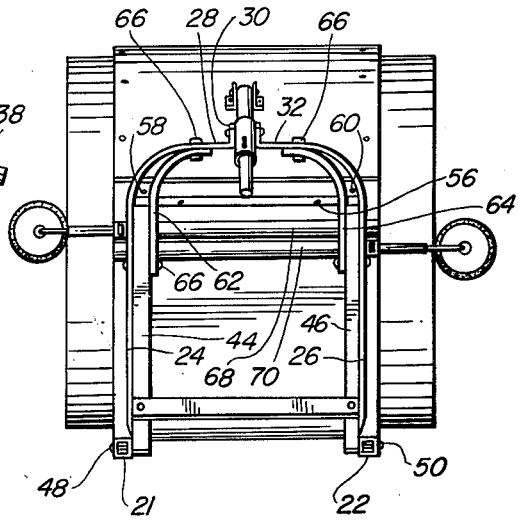
FIG. 2 is a rear elevational view taken along the line 2—2 of FIG. 1.
Figure 3:
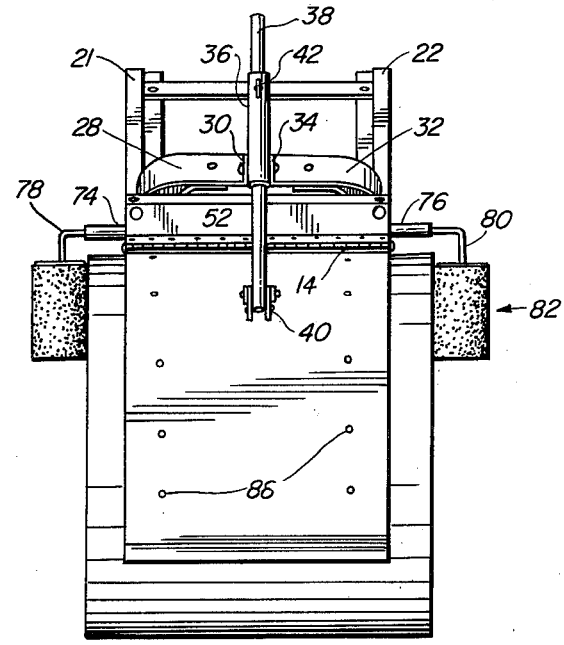
FIG. 3 is a top elevational view of the device of FIG. 1.
Figure 5:
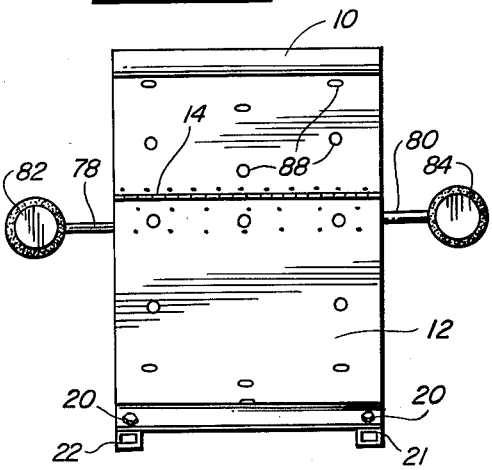
FIG. 5 is a front elevational view with the upper plate shown full extended taken substantially on the line 5—5 without the aluminum roll therein.

The horizontally disposed base frames are spaced apart as shown in FIGS. 2, 3 and 5 and preferably constructed of a square steel tubing to lighten the full unit. The side frame members 24, 26 are bolted as at 25, respectively, or otherwise secured at one end to the respective base frame 21, 22. The side frame member 25 extends upwardly and rearwardly at an angle of about 105° terminating in a substantial right angle inward bend 28, with the terminal end again bent upwardly at right angles, as at 30. The frame member 26 is identical to the side frame 24 except the upper end 32 is also bent inwardly and terminates in an upward bend 34.

An elongated sleeve or tube 36 is pivotally secured adjacent one end between the right angle members 30, 34 to support an elongated shiftable rod 38. One end 40 of the rod 38 is pivotally supported in the trunions 40 secured to the upper face plate 10. The sleeve 36 is provided with a thumbscrew 42 for positioning the rod as desired, i.e., for adjusting the upper plate 10 towards or away from the lower plate 12.

Figure 4:
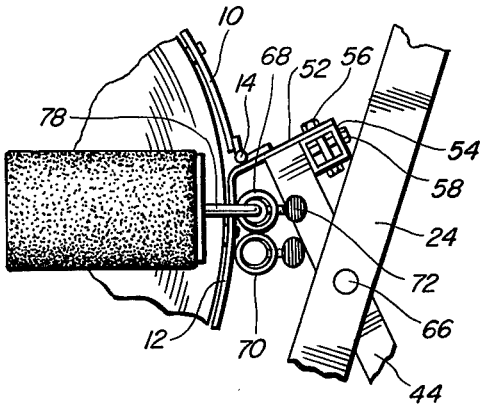
FIG. 4 is a fragmentary elevational view taken within the circle of FIG. 1.

The rear frame members 44, 46 are each secured at one end to the rear of base frames 21, 22, respectively, by bolts 48, 50, or otherwise secured. These rear frames extend upwardly and forwardly at an angle of substantially 60° until they contact the lower face of the upwardly and rearwardly extending member 52 which is an integral part of the upper end of the lower plate 12, all as clearly shown in FIG. 4. A hollow elongated cross bar 54, square in cross section, is anchored to the lower face of member 52 at the transverse marginal end thereof by bolts 56 which extend therethrough, or by any other anchoring means. The free ends of the rear frame members are anchored to the sleeve by bolts 58, 60 or by any other suitable anchoring means.

The upper ends of strengthening bars 62, 64 are bent inwardly on a radius towards each side member 24, 26, respectively, and are anchored to the upper portion of the side frame members 24, 26, respectively, by bolts 66 while the lower ends are anchored by common bolts 67, 69 to the rear frame members 44, 46, respectively, and the side frame members 26, 24, respectively. Thus all these frame members are fixedly secured together.

A pair of sleeves 68, 70 disposed one on the other are each fixed to the outer or rear face of the lower plate 12 and extend thereacross. Each is provided with a thumbscrew 72 adjacent the right and left hand ends, respectively, of each sleeve, as shown in FIG. 2. Elongated tubes 74, 76 slidably seat in respective sleeves 70, 68 and are each provided at one end thereof with a right angled rod 78, 80, respectively. The rods 78, 80 are fixedly secured at one end in the ends of tubes 74, 76, respectively, while the other end of the rods 78, 80 carry rotatable drums 82, 84, respectively, covered with a soft fabric.

Each of the plates 10, 12 has plastic rivets 86 having enlarged heads 88 for ease of pulling the sheet 90 outwardly of the aluminum coil 92.

In operation, the coil of aluminum sheeting 92 is placed in the lower plate 12 and the upper plate 10 is lowered to the top of the coil. The setscrew 42 is tightened to retain the coil within the plates 10, 12. As coils of aluminum come in different diameters, it is necessary that the upper plate 10 be capable of shifting downwardly or upwardly as desired and adjusted to any position about hinge 14 and this is the reason for the sleeve 36, rod 38, thumbscrew 42 and pivot 40 mounted to the upper plate 10.

After the coil 92 is placed between the plates 10, 12 and centered, the thumbscrews 72 are loosened and the rollers 82, 84 moved inwardly until they each contact one side of the coil, as shown in FIG. 1, and the thumbscrews 72 are again tightened and thus the roll of aluminum is kept from moving laterally and at the same time the pulled sheet moves only in one direction.

The device is readily portable and can be carried from one job to another. The aluminum sheet is always kept clean from grass and debris stains.

Although but one specific embodiment of this invention is herein shown and described, it will be understood that details of the construction shown may be altered or omitted without departing from the spirit of the invention as defined by the following claims.

I claim:

1. A device of the class described comprising:

(a) a framework;

(b) a concaved curved lower plate fixed to said framework to support a coil of aluminum sheeting;

(c) a convexed curved upper plate, a hinge said hinge secured to one end of each of said upper and lower plates;

(d) means for fixedly securing said upper plate in variable positions relative to said lower plate;

(e) means on said lower plate to position the coil of aluminum sheeting between said lower and upper plates.

2. The device according to claim 1 wherein the framework comprises a pair of spaced base frames, a pair of side frames each fixed at one end to each base frame, respectively, adjacent one end thereof, a pair of rear frames one fixed to each base frame, respectively, adjacent one end thereof.

3. The device of claim 2 wherein each side frame extends upwardly from said respective base frame at an angle of about 105° and each of said rear frame members extends upwardly from said base members at about 60° and is fixed to said side frame members, respectively.

4. A device of the class described comprising pairs of spaced base, side and rear frames: (a) said side frames affixed at one end to said base frames adjacent one end thereof extending upwardly and one towards the other end of said base frames at approximately 105°;

(b) the upper portions of each of said side frames being bent inwardly and upwardly;

(c) said rear frames secured at one end to said one end of said base frames and extending upwardly and forwardly towards said side frames;

(d) a fixed lower curved plate spanning said base frames having a forward marginal end bent outwardly and downwardly and fixed to said base frames;

(e) the opposed marginal end of said lower plate being bent upwardly and rearwardly;

(f) an upper movable curved plate, said plate having the forward marginal end bent upwardly and outwardly, and an opposed end, a hinge, means for fixing said hinge to said opposed ends of said upper and lower plates;

(g) a sleeve pivoted to the upper ends of said side frame members, a rod slidable in said sleeve, one end of said rod pivoted to said upper plate for adjusting said plate towards and away from said lower plate, and means for adjustably fixing said rod in said plate;

(h) a pair of elongated sleeves affixed to said lower plate, and lying in a plane normal to the plane of said plate and adjacent the bend on said opposed edge;

(i) a pair of tubes each slidably positioned in one of said elongated sleeves, respectively, with one end of each having a right angled bend, a rotary drum on each of said ends; and (j) a series of headed plastic rivets on each plate for ease in removing the contents therebetween.

* * * * *